United States Patent [19]

Paladino

[11] 4,219,947

[45] Sep. 2, 1980

[54] PLOW OR DIGGING MACHINE AUTOMATIC BLADE ADJUSTING AND LOCKING SYSTEM

[75] Inventor: Anthony Paladino, Woodstock, Canada

[73] Assignee: Eddy Oxford Enterprises Limited, Woodstock, Canada

[21] Appl. No.: 903,676

[22] Filed: May 8, 1978

[30] Foreign Application Priority Data

Jan. 20, 1978 [CA] Canada ..... 295380

[51] Int. Cl.[3] ..... A01B 3/64

[52] U.S. Cl. ..... 37/193; 172/683; 172/699; 172/744

[58] Field of Search ..... 37/193, 98; 172/699, 172/700, 713, 683, 744, 481, 254, 675, 753; 405/181

[56] References Cited

U.S. PATENT DOCUMENTS

| | | | |
|---|---|---|---|
| 24,969 | 8/1859 | Watson | 37/193 |
| 127,475 | 6/1872 | Gillette | 172/699 |
| 206,334 | 7/1878 | Jarrell | 172/744 |
| 1,100,920 | 6/1914 | Seay | 172/699 |
| 1,136,172 | 4/1915 | Scott | 172/699 X |
| 2,912,774 | 11/1959 | McCrary | 172/683 X |
| 3,050,135 | 8/1962 | Kelley | 172/699 X |
| 3,274,713 | 9/1966 | Jones | 172/481 X |
| 3,571,956 | 3/1971 | Heiberg | 37/98 |
| 3,713,300 | 1/1973 | Ward | 172/40 X |
| 3,738,432 | 6/1973 | Kelley | 172/699 X |
| 3,752,239 | 8/1973 | Kelley | 172/699 |
| 3,814,191 | 6/1974 | Tilbury | 172/481 X |
| 4,142,817 | 3/1979 | Lazure | 37/193 X |

FOREIGN PATENT DOCUMENTS

| | | | |
|---|---|---|---|
| 655532 | 12/1928 | France | 37/193 |
| 273123 | 6/1927 | United Kingdom | 37/193 |

*Primary Examiner*—Clifford D. Crowder

*Attorney, Agent, or Firm*—Wenderoth, Lind & Ponack

[57] ABSTRACT

A plow apparatus for laying cable, pipe, tile and the like underground having a blade with an upwardly extending shank portion for support. A blade holder connects the shank to a plow-pulling crawler tractor and the holder has an opening therein to receive the shank. An arm is pivotally mounted on the blade holder on one end of the arm to press the shank against an interior surface of the holder in the opening. A blade dog pivotally mounted on the holder is also provided to lock the shank in the holder at a selected height by means of recesses formed on the rear surface of the shank at various heights. One of the recesses is engaged by the blade dog in the locked position. The invention permits one machine operator to quickly and easily adjust the cutting depth of the blade without the use of tools.

17 Claims, 11 Drawing Figures

PLOW OR DIGGING MACHINE AUTOMATIC BLADE ADJUSTING AND LOCKING SYSTEM

BACKGROUND OF THE INVENTION

This invention relates to plows for laying cable, pipe, tile, tubing and the like undergound.

It is well known to provide a special plow behind a tractor such as a bulldozer capable of laying cable or drainage pipe or tile. For example, machines specially adapted to lay cable underground are shown in U.S. Pat. No. 3,348,383 to L. O. Kelly dated Oct. 24, 1967, U.S. Pat. No. 3,571,956 to R. C. Heiberg dated Mar. 23, 1971 and U.S. Pat. No. 3,905,200 to W. A. Ylinen dated Sept. 16, 1974. Such machines must generally be provided with mechanisms for raising the plow above the ground when not in use and lowering the plow into the ground for ripping a suitable trench. In addition to this mechanism for raising and lowering the plow, it is generally desirable to provide an adjustment mechanism whereby the depth of the plow in the ground can be adjusted. It will be appreciated that the desired depth of the cable or pipe will vary from job to job depending on soil conditions, the type of cable or pipe being laid, the nature of the terrain etc. In the past, it has been a common practice to adjust the height of the blade with respect to the blade holder simply by manual labour and hand tools and adjusting the height of the blade in this manner can be both dangerous and time consuming.

In one known embodiment of a drainage and cable installation plow, the height of the blade in the blade holder is adjusted by removing some pins, unlocking the blade by hand and then positioning the pins in other holes provided in the blade. While these operations are being carried out by one man at the blade location, it is necessary for another man to operate a linkage mechanism which supports the blade holder by means of controls on the crawler tractor. This known construction for a drainage and cable installation plow has the further disadvantage of requiring a number of holes in the blade and these holes can cause undue stresses to be set up in the blade during operation thereof and even eventual blade failure.

In U.S. Pat. No. 3,905,200 referred to previously, a cable installation plow is adjustably mounted in a blade holder having a vertically extending rectangular channel for slidably receiving the plow blade. A double acting fluid cylinder is provided along one side of the blade holder and it has a piston rod connected to the plow blade. By selected operation of the cylinder, the plow blade can be raised or lowered with respect to the carrier. With this known arrangement, no means are provided for adjusting the angle of pitch of the blade in the ground without adjusting the height of the blade holder with respect to the ground.

In the aforementioned U.S. Pat. No. 3,348,383 the blade shank is provided with a series of adjustment holes formed therein and a couple of pins extend through two of the holes to atttach the blade to the supporting mechanism. By repositioning the two pins in other holes the height of the blade can be adjusted. This patent specification also teaches the use of an adjustment brace connected to the upper end of the plow whereby the angularity of the digging point of the plow can be adjusted by turning the brace about its center axis. The use of the adjustment holes 60 of course creates the disadvantage mentioned earlier, that is, it weakens the blade shank which may be subject to considerable stresses during operation of the plow.

SUMMARY OF THE INVENTION

The plow apparatus of the present invention for laying cable, pipe, tile, tubing and the like underground comprises a blade mechanism having an upwardly extending support portion and a blade holder for connecting the support portion to a plow-pulling vehicle. The holder has an opening therein to receive the support portion. Means are provided for pressing the support portion against an interior surface of the holder in the opening. Further means are used to lock the support portion in the holder at a selected height. Thus the cutting depth of the blade mechanism can be readily adjusted.

The locking means includes a blade dog movably mounted on the blade holder and recesses formed on the support portion of the blade mechanism at various heights. One of these recesses is engaged by the dog in the locked position of the apparatus. The pressing means preferrably includes an arm pivotally mounted on the blade holder at one end of the arm and means for pivotting the arm so that the other end of the arm is pressed against or moved away from the support portion as desired.

The invention will be better understood from the following detailed description of preferred embodiments taken in conjunction with the accompanying drawings.

DETAILED DESCRIPTION OF PREFERRED EMBODIMENT

Figure 1:
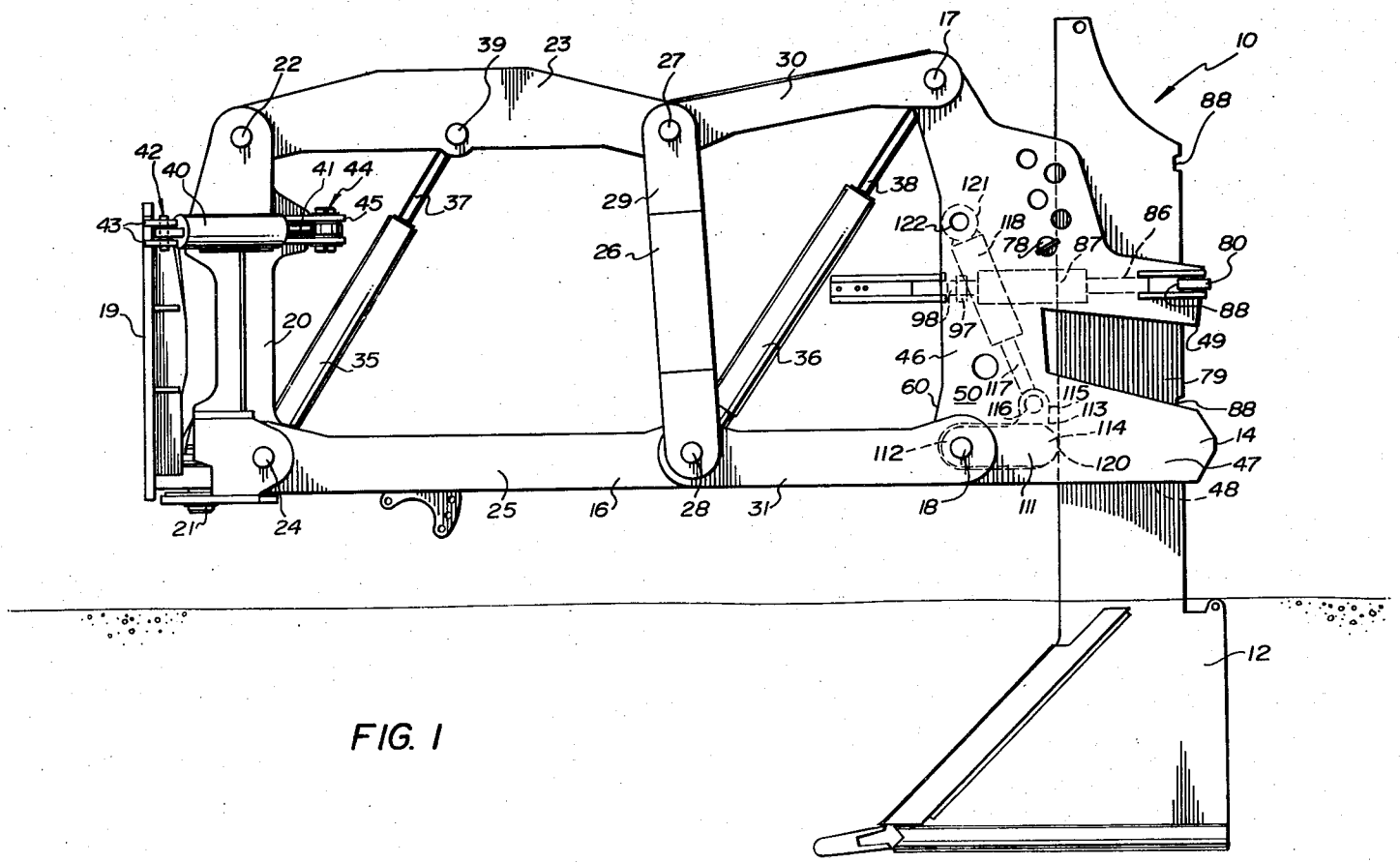
FIG. 1 is a side view of a plow apparatus which embodies the present invention.

The plow apparatus 10 shown in FIG. 1 comprises two basic parts consisting of a blade mechanism 12 and a blade holder 14. In addition, the plow apparatus can include a supporting linkage mechanism 16 for connecting the blade holder 14 to a plow-pulling vehicle (not shown) such as a crawler tractor or bulldozer. The linkage mechanism is pivotally connected at upper pivot pin 17 and lower pivot pin 18 to the blade holder.

The front end of the linkage mechanism is connected to the crawler tractor by means of a reinforced mounting plate member 19 which is rigidly connected to the rear end of the crawler tractor.

The linkage mechanism 16 includes a vertical support member or mast 20 which is mounted to pivot about a vertical axis extending through a lower pivot pin 21 and an upper pivot pin (not shown) located near the top of the plate member 19. Pivotally connected to the upper end of the mast 20 by means of pin 22 is a front top link member 23 which preferably consists of two spaced apart steel plates connected together by suitable webbing in order to provide the required rigidity. Pivotally connected to the bottom end of the mast 20 by means of pin 24 is a front bottom link member 25 which preferably consists of a relatively wide, open top channel member. Thus, in the preferred embodiment, the bottom link member 25 is wider than the top link member 23. The rear ends of members 23 and 25 are pivotally connected together by means of a centrally located connecting link 26 having pivot pins 27 and 28 at opposite ends thereof. The connecting link 26 is constructed in a manner similar to the construction of link member 23 but the two plate members 29 which make up the sides of the connecting link 26 taper inwardly towards the top to accommodate the different widths of link members 23 and 25. The linkage mechanism further comprises a rear top link member 30 pivotally connected to the rear end of link member 23 and to the top end of blade holder 14. The member 30 is constructed in a similar fashion as link member 23 except that it is shorter and of less depth. In addition a rear bottom link member 31 pivotally connects the rear of the link member 25 to the bottom end of the blade holder 14.

In order to control the position of the link members relative to one another and to provide the means for raising the blade mechanism above the ground surface or lowering the blade mechanism into the ground, a couple of relatively large hydraulic cylinders 35 and 36 and cooperating pistons 37 and 38 are provided. The combination of the cylinder 35 and piston 37 is hereinafter called the lifting cylinder since this mechanism provides the primary means for lifting the blade mechanism clear of the ground. The bottom end of the cylinder 35 is pivotally connected to the bottom end of the mast 20 while the upper end of piston 37 is pivotally connected by means of pin 39 to approximately the center of front top link member 23. Thus movement of the piston 37 in the outward direction will raise the blade holder 14 together with the blade while inward retraction of the piston 37 will drive the blade mechanism into the ground to rip the required trench for a cable or pipe. The combination of cylinder 36 and piston 38 is hereinafter termed the link cylinder since it is this mechanism which controls the position of the blade holder and connecting rear link members 30 and 31. The bottom end of cylinder 36 is pivotally connected to the adjoining link members by means of the pivot pin 28 while the upper end of piston 38 is pivotally connected to the blade holder by means of the pivot pin 17.

In addition to the aforementioned hydraulic cylinders and pistons, there is a further hydraulic cylinder 40 and cooperatig piston 41 located at the front of the linkage mechanism. The closed end of cylinder 40 is pivotally connected to the plate member 19 by means of a pivot pin 42 together with a support bracket 43 rigidly connected to the rear of plate member 19. The front end of the piston 41 is provided with an opening for a pivot pin 44 which is supported by a further bracket 45 rigidly connected to the front of mast 20. It will be appreciated that the cylinder 40 and piston 41 provide means for pivoting the linkage mechanism 16 about the vertical axis extending through the pivot pin 21. Thus the plow apparatus 10 can be angled with respect to the longitudinal axis of the crawler tractor so that the blade mechanism can follow a curved pattern.

Figure 2:
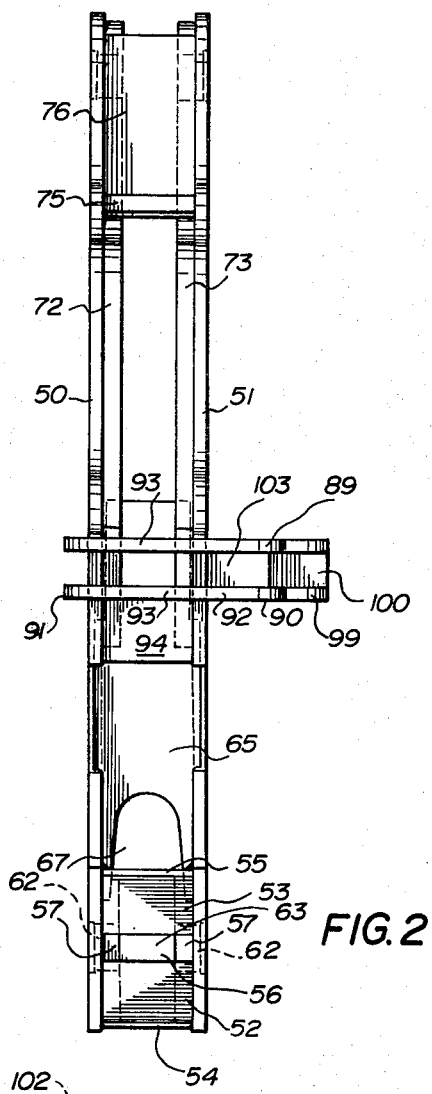
FIG. 2 is a rear end view of the blade holder shown in FIG. 1.
Figure 3:
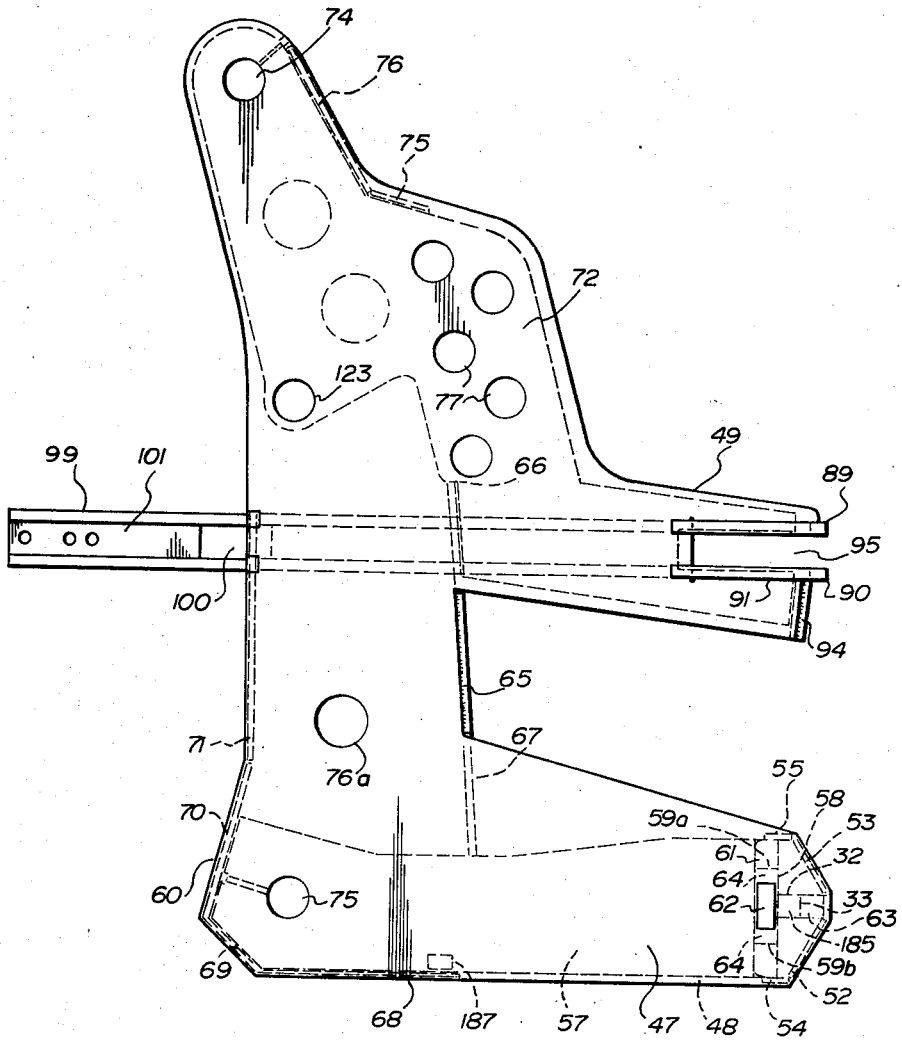
FIG. 3 is a side view of the blade holder shown in FIG. 2.

Turning now to the blade holder 14 which is best shown in FIGS. 1, 2 and 3, this blade holder is designed to hold and support the blade mechanism 12 during operation of the plow apparatus and also during transport of the plow apparatus and crawler tractor from one job site to another. The blade holder shown includes a vertically extending front portion 46, a first horizontal portion 47 extending rearwardly from the bottom end of the front portion 46 and containing an opening 48 for the blade mechanism, and a second horizontal portion 49 extending rearwardly from the front portion 46 and spaced above the first horizontal portion 47. The two sides of the blade holder are formed by two large plate members 50 and 51, with one plate member being located on each side of the blade mechanism 12. The two plate members 50 and 51 are rigidly connected together by a number of interconnecting plates or web members including interconnecting plates 52 to 55 located at the outer end of the horizontal portion 47. The relatively small plate 55 is located adjacent the top of horizontal portion 47 and extends substantially horizontally. The small horizontal plate 54 is welded near the bottom edges of plate members 50 and 51. The large plates 52 and 53 extend at an angle to the horizontal from plates 54 and 55 respectively to a central region of portion 47. The adjacent ends of plates 53 and 52 are separated by a small gap at 56. The plate members 50 and 51 are strengthened in the area of horizontal portion 47 by means of further steel plates 57 located on the inside surfaces of plate members 50 and 51. Each plate member 57 extends from the front edge 60 of front portion 46 to the plates 52 and 53. A strong abutment surface for engaging the blade mechanism is provided at the outer end of the horizontal portion 47 and this abutment surface includes a thick, vertical plate member 61 having two protuberances 62 located on opposite sides. The protuberances 62 extend snuggly into openings formed in each of plate members 50, 51 and 57.

The openings formed in the plates 50 and 51 are rectangular as shown in FIG. 3 while the openings 58 in the plates 57 are larger and in the shape of a T laid on its side. The top and bottom edges of the vertically extending portion of each opening 58 are located at **59*a* and 59*b* respectively and each opening 58 snuggly accommodates a larger base portion 64 of the respective protuberance 62. Each opening 58 also has a horizontally extending portion 32 having its rear edge located at 33. The member 61 which can be made of steel plate having a preferred thickness of 1½ inches is welded into place. The plate member 61 is further supported by a small, thick plate member 63 extending between reinforcing plates 57 and having its front edge located along a central portion of plate member 61. The plate 63 has two short horizontal extensions 185 on opposite sides thereof which project snuggly into the portions 32 of the openings in the plate members 57. The plate members 57, 61 and 63** are welded firmly together and are interlocked as described to provide the strong support for the plow blade.

Connecting the front edges of the plate members 50 and 51 along front portion 46 is a generally vertical connecting plate 65 which extends from the top edge of the reinforcing plate 57 to a point 66 located approximately in the same horizontal plane as the top of the second horizontal portion 49. An opening or recess 67 is formed in the bottom edge of the plate 65 for a purpose which will become clear hereinafter. Along the bottom of the blade holder in the region of front portion 46 is a further connecting plate 68 welded to the inside of each of the plate members 50, 51. Sloping upwards from plate 68 to the front edge 60 is a smaller connecting plate 69. Extending along the bottom half of the front edge 60 are two further connecting plates 70 and 71. The top of plate 71 is located at about the same height as the second horizontal portion 49.

The upper portion of the blade holder 14 is also reinforced by two additional inner plate members 72 and 73 which extend from the top of the blade holder down to and along the second horizontal portion 49 to the rear end thereof. In one particular preferred embodiment, each plate consists of 1¼ inch steel plate. One of the inner plates 72 and 73 is attached to each of plate members 50 and 51, preferably by welding. There are two further connecting plate members 75 and 76 located near the top end of the blade holder. In order to accomodate the previously mentioned upper and lower pivot pins 17 and 18, holes 74 and 75*a* are formed in the blade holder and they extend completely through the blade holder from one side to the other. A further hole 76*a* may be formed in the front portion 46 of the holder if desired. A series of five further holes 77 are preferrably formed above the second horizontal portion 49 near the rear side of the blade holder. These holes are adapted to accommodate an adjustment pin 78 shown in FIG. 1 whose purpose is explained hereinafter.

Figure 5:
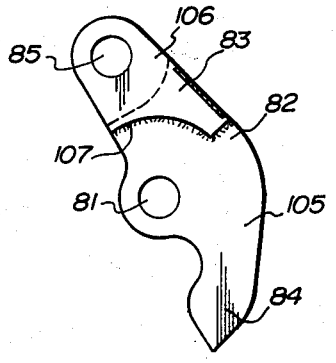
FIG. 5 is a plan view of the blade dog which is pivotally connected to the blade holder.
Figure 4:
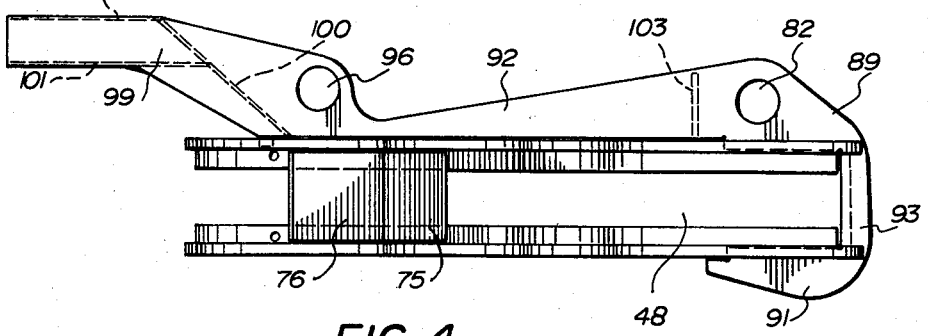
FIG. 4 is a top plan view of the blade holder shown in FIGS. 2 and 3.

The plow apparatus of the present invention provides means for locking a support portion or shank 79 of the blade mechanism in the blade holder 14 at a selected height in such a manner that the cutting depth of the blade mechanism can be adjusted if desired. The locking means preferably comprises a blade dog 80 shown in detail in FIG. 5. The dog 80 is pivotally mounted on the blade holder 14 by means of a pivot pin extending through hole 81 in the dog and a further hole 82 provided in the side of the blade holder The hole 81 is centrally located on the blade dog and extending from the center portion of the blade dog there are a straight arm 83 and a curved arm 84. The outer end of the arm 83 is provided with a hole 85 for connecting the arm by means of a pin to the outer end of a hydraulic piston 86 shown in FIG. 1. The piston 86 together with cylinder 87 provides hydraulic means for pivoting the blade dog 80 about the vertical axis extending through the center of hole 81. The outer end of the arm 84 is flat and is adapted to engage in one of several recesses 88 formed in the rear surface of the blade shank 79. In the illustrated shank there are three such recesses 88 so that the blade mechanism can be arranged at three different heights relative to the blade holder 14. When the blade mechanism is in the locked position, the front surface of the shank 79 is pressed against the aforementioned adjustment pin 78.

There are two, spaced apart, parallel supporting plates 89, 90 extending horizontally across the blade holder in the region of the second horizontal portion 49. Each of these plates has a short portion 91 located on one side of the blade holder and a considerably longer portion 92 located on the other side of the blade holder. The portions 91 and 92 are connected together by means of an end portion 93 which extends across the rear end of the horizontal portion 49 of the blade holder. In addition, a rectangular plate 94 extends between the plate members 50 and 51 below the lower end portion 93 and is welded to the plate members 50 and 51. Thus the outer end of the horizontal portion 49 is effectively closed so that the shank 79 is always held in the slot in the blade holder formed between the plate members 50 and 51. The aforementioned hole 82 is formed in each of the longer portions 92 near the rear thereof. A slot is cut in the two plate members 50 and 51 to accommodate the arm 84 of the blade dog and this slot extends between the two support plates 89 and 90. In the vicinity of the front surface of the blade holder is a further hole 96 which also extends through both support plates 89 and 90. This hole 96 accommodates a pivot pin 97 shown in dotted lines in FIG. 1. A lug 98 connected to the closed end of hydraulic cylinder 87 extends between the two support plates 89 and 90 and has a hole formed therein through which pin 97 extends. Thus the cylinder 87 is free to pivot as required as it operates the blade dog 80.

If desired, the support plates 89 and 90 can extend forward past the front of the blade holder 14 as shown to provide support for a laser mast which can be used to maintain the plow apparatus in proper alignment for the laying of a cable or pipe. In the embodiment illustrated, the laser mast support 99 includes vertically extending connectig plates 100 to 102 extending between the support plates 89 and 90. In addition, if desired, there may be an additional small connecting plate 103 extending between the plates 89 and 90 a short distance in front of the hole 82.

The blade dog can be constructed from three plate members consisting of a large thick plate member 105 and two smaller plate members 106. The plate member 105 is preferrably constructed of steel plate having a thickness of 1½ inches or more. The smaller plates 106 are located in the region of the arm 83 on the upper and lower surfaces of the plate member 105. Each plate member 106 is cut away along a curved inner edge 107 so that the plates 106 will not interfere with the pivoting movement of the blade dog.

The plow apparatus of the present invention also includes means for pressing the support portion or shank 79 of the blade mechanism against an interior surface of the blade holder 14 in the opening 48 formed in the blade holder The opening 48 is formed between the plate members 50 and 51 in the first horizontal portion 47. The pressing means preferrably includes an arm 111 shown in dotted lines in FIG. 1 which is pivotally mounted on the blade holder 14 at one end 112 of the arm by means of the aforementioned pin 18. This arm 111 which is located between the plate members 50 and 51 is preferrably constructed from two plate members 113 and 114 with the plate member 114 being quite thick such as 2 inches while plate member 113 can be relatively thin. The plate 114 is substantially the shape of an elongated oval while plate member 113 is L-shaped and includes an upwardly extending arm 115. A hole extends through both plate members 113 and 114 to accommodate the pivot pin 18 and a further hole is provided at 116 in the arm 115 to accommodate a pin connecting the arm 115 to a hydraulic piston 117. The piston 117 together with a cooperating hydraulic cylinder 118 provide means for pivoting the arm 111 so that the other end 120 can be pressed against or moved away from the front surface of the shank 79 as desired. It will thus be seen that the shank 79 can be firmly clamped between the plate member 61 in the rear end of horizontal portion 47 and the end 120 of the arm 111. The shank is clamped in this manner after the desired height of the blade mechanism in the blade holder has been selected and the blade dog 80 has been engaged with one of the recesses 88. The engagement of the arm 111 against the front surface of the shank locks or holds the shank firmly in position so that the blade mechanism cannot move back and forth inside the blade holder.

In one particular preferred embodiment, the end 120 of the arm 111 is engaged with the front surface of the shank by pivoting the arm 111 in a clockwise direction (as seen in FIG. 1). By locating the horizontal pivot pin 18 above a horizontal plane extending through the point of contact between the end 120 and the shank 79, an overcenter arrangement can be provided whereby a firm clamping of the shank between the end 120 and the plate 61 is ensured at all times. The overcenter arrangement is further achieved by providing a stop member 187 for the arm 111 which extends between the plate members 57 and is welded thereto (See FIG. 3). This stop member is located just above and near the rear end of the connecting plate 68. The location and thickness of the stop member 187 are such that the lowermost position of the arm 111 results in a point of contact between the end 120 and the shank 79 slightly below a horizontal plane extending through pivot pin 18. Working forces pushing on the blade mechanism and tending to push the shank 79 forward in the blade holder will not tend to loosen the hold provided but will only tend to create a firmer hold on the shank since the arm 111 cannot move further downwards. Only the actuation of the piston or rod 117 can move the arm 111 upwardly and away from engagement with the plow blade.

The upper end of the hydraulic cylinder 118 has a suitable lug 121 which accommodates a pivot pin 122 extending through a hole 123 formed in both of the plate members 50 and 51. Thus the cylinder 118 is free to pivot as required during operation of the arm 111.

The adjustment pin 78 together with the series of holes 77 provide means for adjusting the pitch of the blade mechanism 12 simply by means of moving the adjustment pin from one hole 77 to another. The forward surface of the shank 79 is always forced against the adjustment pin 78 by the blade dog 80. In the position shown in solid lines in FIG. 1, the bottom of the blade mechanism is horizontal but by changing the position of the adjustment pin 78 and thus the pitch of the blade mechanism, the blade bottom can be placed at a small acute angle to the horizontal. In a particular preferred embodiment, the series of holes 77 permit the pitch of the blade to be adjusted a minimum of 4° in either direction from the horizontal as desired. A lesser inclination to the horizontal such as 2° can also be obtained.

In order to adjust the height of the blade mechanism, the arm 111 is disengaged first by retracting the piston 117 and then the blade dog 80 is disengaged. The operator is then free to adjust the height of the blade mechanism in the blade holder as desired by moving the blade holder up or down. To lock the blade mechanism in its new position, the blade dog 80 is pivoted first to engage one of the recesses 88. The arm 111 is then pivoted clockwise so as to press firmly against the blade mechanism.

Figure 6:
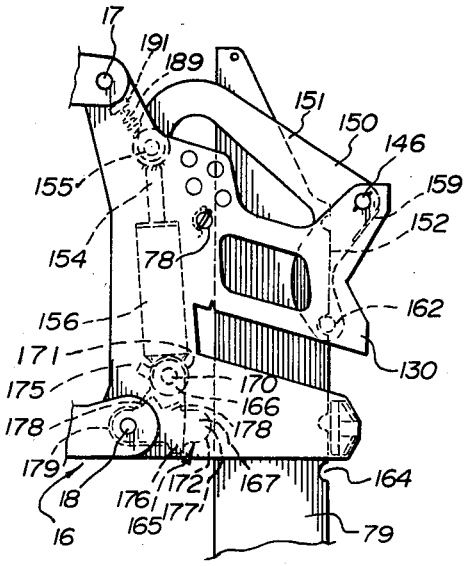
FIG. 6 is a partial side view of another embodiment of a plow apparatus which embodies the present invention.
Figure 7:
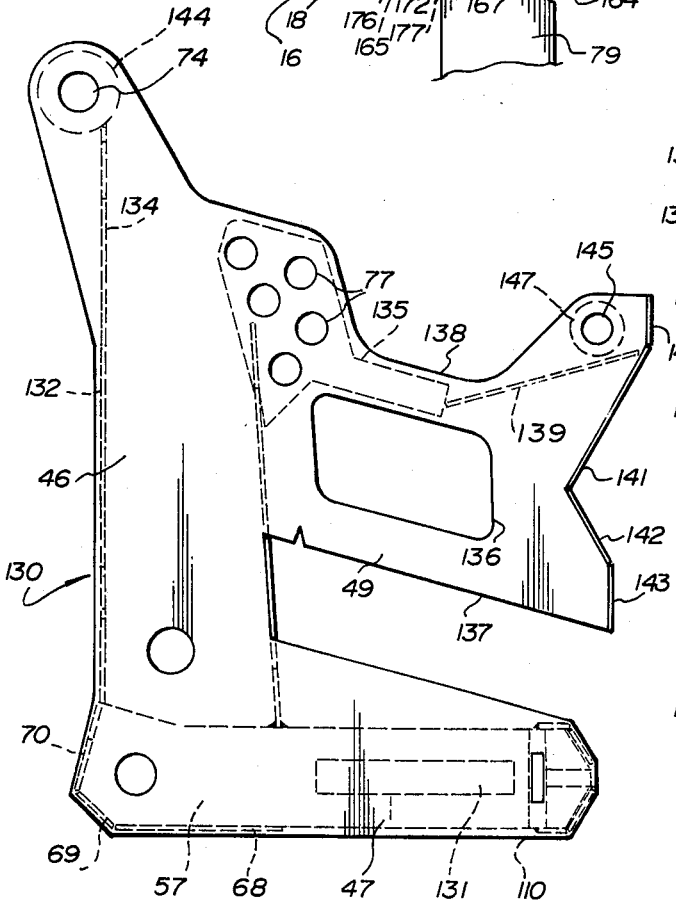
FIG. 7 is a side view of the blade holder shown in FIG. 6.
Figure 8:
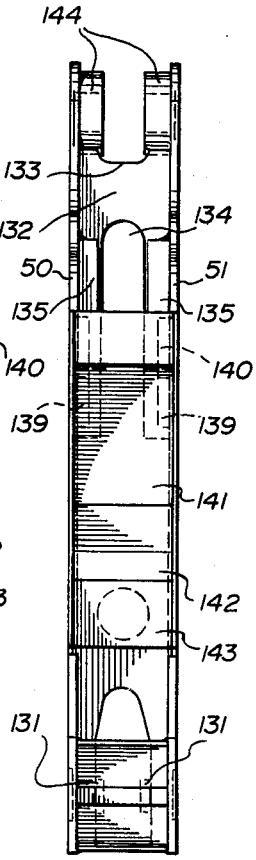
FIG. 8 is a rear end view of the blade holder shown in FIG. 7.
Figure 9:
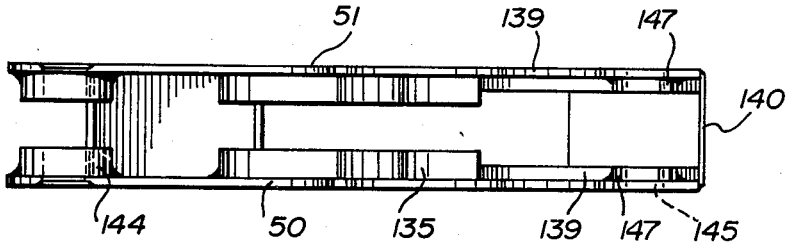
FIG. 9 is a top plan view of the blade holder shown in FIGS. 7 and 8.

Turning now to the second embodiment of a plow apparatus shown in part in FIG. 6 of the drawings, the linkage mechanism 16 and the blade mechanism 12 in this embodiment are essentially the same as the first embodiment illustrated in FIG. 1. The blade holder 130 is also similar in many respects to the blade holder 14 shown in FIGS. 1 and 3 and only those aspects of the blade holder 130 which differ from those of the blade holder 14 will be described herein with reference to FIGS. 7 to 9 wherein the blade holder 130 is shown in detail.

The first horizontal portion 47 of the blade holder 130 has two additional reinforcing or wear plates 131 in addition to the thick reinforcing plates 57. Each plate 131 extends almost the entire length of the opening 110 and has a height approximately ⅓ that of the plates 57. Each plate 131 is firmly welded at the top and at the bottom to the inside surface of an adjacent plate 57. Extending along the front surface of the front portion 46 of the blade holder is a relatively long connecting plate 132 which extends from the top edge of the connecting plate 70 to the upper front corner of the blade holder which is connected to the pivot pin 17. The upper edge of the plate 132 can be recessed at 133 so as not to interfere with the connecting of the piston 38 and the pivot pin 17. In addition an opening 134 can be cut in the plate 132 if desired to provide access to the space between the two side plate members 50 and 51 in the front portion 46. Reinforcing inner plates are also provided in the blade holder 130 but these plates 135 are considerably smaller in area than the plates 72 and 73 of the first embodiment. In particular the two plates 135 merely extend over the area of the holes 77 and along the top portion of the second horizontal portion 49.

In the second embodiment of the blade holder, the second horizontal portion 49 has a greater width in the vertical direction than in the first embodiment and a hole 136 of parallelogram shape is formed therein. The hole 136 has a length equal to approximately one half the length of the horizontal portion 49 and the hole's length is almost twice as long as its short side. The long sides of the hole 136 extend parallel to the bottom edges 137 and top edges 138 of the horizontal portion. Additional reinforcing bars 139 can be provided in the region extending from the rear end of the inner plates 135 to the rear upper end of the horizontal portion 49. Each of these bars 139 is firmly welded to the inner surface of an adjacent side plate member 50 or 51. Extending along the rear end of the horizontal portion 49 are a series of connecting plate members 140 to 143 which effectively close off the rear end of the horizontal portion. The central plate members 141 and 142 are arranged at an obtuse angle to one another so as to form a V-shaped recess or notch. Each of these connecting plate members is of course firmly welded to each of the side plate members 50 and 51.

The hole 74 in the top front corner of the blade holder 130 is reinforced by short cylindrical sleeves 144 each of which is welded to the inner surface of an adjacent plate member 50 or 51. A gap is provided between the two sleeves 144 to accommodate the connecting end portion of hydraulic piston 38. A further hole 145 having a horizontal axis is formed in the upper rear corner of the horizontal portion 49 and this hole accommodates a pivot pin 146 shown in FIG. 6. The hole 145 is also reinforced by the use of short cylindrical sleeves 147 which are also firmly welded to the inner surface of the adjacent plate member 50 or 51.

The second embodiment of the plow apparatus shown in FIG. 6 is also provided with locking means including a blade dog 150 pivotally mounted on the aforementioned pivot pin 146 which is located rearwardly from the blade shank 79. As with the blade dog in the first embodiment, the blade dog 150 is adapted to press the shank 79 against a support member such as the adjustment pin 78 mounted in the blade holder. The blade dog 150 is a generally L-shaped member having two arms 151 and 152 extending from a central pivot portion 153 pivotally connected to the blade holder. The outer end of the arm 151 is pivotally connected to a piston 154 by means of a pin member 155. A hydraulic cylinder 156 together with the piston 154 provide hydraulic cylinder means for pivoting the blade dog 150. The cylinder 156 and the piston are mounted in a space formed between the two side plate members 50 and 51 of the blade holder.

Figure 11:
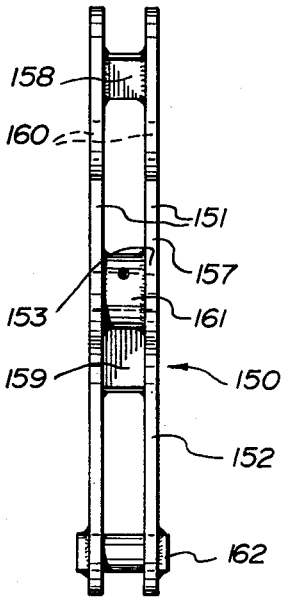
FIG. 11 is a front end view of the pivotable arm which forms part of the locking means in the embodiment of FIG. 6.

The blade dog 150 is constructed from two flat side plates 157 as shown in FIG. 11 and these plates are connected together by two connecting plates 158 and 159. The plate 158 is located near the outer end of the arm 151 adjacent the pin member 155 which is accommodated in holes 160 formed in the side plates 157. The connecting plate 159 is located in the central pivot portion 153 of the blade dog along the lower rear edges thereof. Extending between the side plates 157 in the central pivot portion 153 is a short cylindrical sleeve 161 which is rigidly connected such as by welding to each side plate 157. This sleeve 161 snuggly accommodates the pivot pin 146 which connects the blade dog to the blade holder.

Mounted at the lower end of the arm 152 is a dog pin 162 which extends through a suitable hole formed in each side plate 157 and projects a short distance outwardly from each side plate. This dog pin is welded to each side plate on the outer surface of each plate. The cylindrical dog pin is provided to engage one of the four recess 164 formed in the rear surface of the blade shank 79. Unlike the recesses 88 in the first embodiment, each recess 164 is semi-circular in cross section as shown in FIG. 6 to snuggly accommodate the dog pin.

Figure 10:
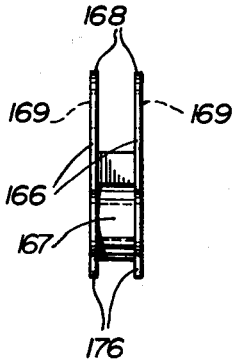
FIG. 10 is a front end view of a blade clamp which forms part of the pressing means in the embodiment of FIG. 6.

The second embodiment of the plow apparatus which is shown in FIG. 6 is also provided with means for pressing the shank 79 against an interior surface of the blade holder in the opening 110. In the second embodiment, this pressing means includes a relatively short arm 165 pivotally mounted on the blade holder 14 at one end of the arm by means of the pivot pin 18. The arm 165 as can be seen from FIG. 10 is made from two flat side plates 166 connected together by means of a single, relatively thick connecting plate 167. Each side plate 166 has an upward extension 168 with a hole 169 formed therein to accommodate a pivot pin 170. The pivot pin 170 extends through a hole in a connecting lug 171 rigidly connected to the bottom end of the hydraulic cylinder 156. It will thus be seen that the short arm 165 is pivotally connected to the hydraulic cylinder 156 which provides means for pivoting the arm so that the end 172 thereof can be pressed against or moved away from the shank 79 as desired. The end 172 is formed by one end of the thick connecting plate 167 which is rounded and projects from the rear edges of the side plates 166.

Suitable stop means can be formed on the side plates 166 to limit the movement of the arm 165 as desired. In particular a stop means 175 in the form of a short projection formed on each upward extension 168 is provided to limit anticlockwise movement of the arm 165 as shown in FIG. 6. The retraction of the piston 154 into the hydraulic cylinder 156 will cause the arm 165 to pivot anticlockwise until the stop means 175 engages the connecting plate 132 of the blade holder. Further stop means 176 in the form two projections extending from the bottom edges of the side plates 166 are provided to limit the clockwise movement of the arm 165. Outward extension of the piston 154 from hydraulic cylinder 156 will cause the arm 165 to be pivoted clockwise until the stop means 176 engages connecting plate 68 of the plate holder. Preferably the central longitudinal axis of the pivot pin 18 in this embodiment is located above a horizontal plane extending through the point of contact 177 between the arm 165 and the shank 79 when the pressing means is fully engaged with or pressed against the shank 79. In this fully engaged position, the stop means 176 prevents any further clockwise movement of the arm 165. Thus, even though forces acting on the blade mechanism may tend to force the shank 79 forward in the blade holder, this will not decrease the holding force of the pressing means or its engagement with the shank because of the overcenter mounting arrangement of the arm 165. The arm 165 can only be pressed downwardly by the shank in this position and this downward movement is prevented by the stop means 176 and the plate 68.

The connecting plate 167 has two short upward extensions 178 which form a V-shaped notch to accommodate the aforementioned lug 171 on the bottom of the hydraulic cylinder. The front end 179 of plate 167 can be made slightly larger than the front ends of the side plates 166 to accommodate the welding of plates 166 and 167 together.

As will be seen from the above description, the hydraulic pivoting means consisting of cylinder 156 and piston 154 provide means for pivoting both the pressing arm 165 and the blade dog 150, thus avoiding the use of two separate hydraulic cylinder arrangements as in the embodiment of FIG. 1. One or more tension springs 189 are mounted near the top of the blade holder 130 and are connected at one end to the upper end of the hydraulic piston 154 and at the other end to a support bar 191. The bar 191 extends between the inner surfaces of plate members 50 and 51 and is welded thereto. The spring or springs 189 will hold the cylinder 156 in an "up" position when the blade dog 150 and the arm 165 are disengaged from the plow blade. In other words the cylinder 156 will be positioned upwardly from the position shown in FIG. 6. Extension of the hydraulic piston 154 will thus result in the blade dog 150 being engaged in the recess 164 first and then further extension of the hydraulic piston will pivot the arm 165 so that it is pressed against the front of the blade shank. Because of the spring 189, the tensile force of which must be overcome to disengage the blade dog 150, retraction of the piston 154 will first disengage the arm 165 and pivot the arm to a position where it can no longer move anticlockwise because of connecting plate 132. Then further retraction of the piston 154 will force the blade dog 150 to be pivoted anticlockwise so that it is disengaged from its recess 164. The operator of the machine is then free to move the blade mechanism up or down in the blade holder as desired by raising or lowering the aforementioned linkage mechanism 16.

It will thus be seen that both embodiments of the plow apparatus of the present invention permit a single machine operator to quickly and easily adjust the height of a plow blade mechanism without tools and preferrably from a control panel (not shown) located on the crawler tractor. It will be understood, however, that the control panel can be located elsewhere such as on the plow apparatus if desired. It will further be noted that the plow apparatus of the present invention avoids the use of stress inducing holes in the blade mechanism and particularly the shank 79.

Hydraulic hoses, of course, extend to and from the hydraulic cylinders used in the above described plow apparatus but these hoses have not been shown for the sake of clarity and the use and arrangement of these hoses will be obvious to one skilled in the construction of hydraulic systems. It will also be appreciated that other types of actuators could be used if desired, to move the arms and/or blade dogs. For example, one might employ mechanical screw jacks or rack and pinion devices.

What I claim as my invention is:

1. A plow apparatus for laying cable, pipe, tile, tubing and the like under ground comprising a blade mechanism having an upwardly extending support portion, a blade holder for connecting said support portion to a plow-pulling vehicle, said holder having an opening therein to receive said support portion, means for pressing said support portion against an interior surface of said holder in said opening, and means for locking said support portion in said holder at a selected height wherein the cutting depth of said blade mechanism can be adjusted, said locking means including a blade dog movably mounted on said blade holder and recesses formed on said support portion at various heights, one of said recesses being engaged by said dog in the locked position, wherein said pressing means includes an arm pivotally mounted on said blade holder at one end of said arm and means for pivoting said arm so that the other end of the arm is pressed against or moved away from said support portion as desired.

2. A plow apparatus according to claim 1 wherein said pivoting means is also adapted to pivot said blade dog, said pivoting means being connected at one end thereof to an end of said blade dog.

3. A plow apparatus according to claim 2 wherein said pivoting means is a single hydraulic cylinder and a cooperating piston arranged in a vertical plane extending parallel to said blade mechanism, a bottom end of said pivoting means being connected to said arm and the upper end thereof being pivotally connected to said end of said blade dog.

4. A plow apparatus according to claim 3 wherein said blade dog is pivotable about a horizontal axis at a pivot pin located rearwardly from said support portion when said support portion is locked in said holder.

5. A plow apparatus according to claim 4 wherein said blade dog is adapted to press said support portion against a support member of said blade holder.

6. A plow apparatus according to claim 5 wherein said support member is an adjustment pin extending through a first hole formed in said blade holder, said first hole and further holes in said blade holder being provided to permit adjustment of the pitch of the blade mechanism by moving said adjustment pin from one hole to another.

7. A plow apparatus according to claim 1 including further means for pivoting said blade dog, said further pivot means being connected at one end thereof to an end of said blade dog.

8. A plow apparatus according to claim 7 wherein each pivoting means comprises a hydraulic cylinder and a cooperating piston, the further pivoting means lying in a horizontal plane above said arm and connected at the other end to said blade holder.

9. A plow apparatus according to claim 8 wherein said blade dog is adapted to press said support portion against a support member of said blade holder.

10. A plow apparatus according to claim 9 wherein said support member is an adjustment pin extending through a first hole formed in said blade holder, said first hole and further holes in said blade holder being provided to permit adjustment of the pitch of the blade mechanism by moving said adjustment pin from one hole to another.

11. A plow apparatus according to claim 1, wherein said pivoting means for said arm is located generally above said arm and said arm is pivotally mounted on said blade holder by means of a horizontal pivot pin located above a horizontal plane extending through the point of contact between said arm and said support portion when said pressing means is pressing against said support portion and said blade holder includes stop means for preventing further downward movement of said arm when pressing against said support portion, whereby the blade mechanism is pressed more firmly by said pressing means when said plow apparatus is in use and forces on the blade mechanism are tending to push the support portion forward.

12. A plow apparatus for laying cable, pipe, tile, tubing and the like under ground comprising a blade mechanism having an upwardly extending support portion, a blade holder for connecting said support portion to a plow-pulling vehicle, said holder having an opening therein to receive said support portion, means for pressing said support portion against an interior surface of said holder in said opening, and means for locking said support portion in said holder at a selected height wherein the cutting depth of said blade mechanism can be adjusted, said locking means including a blade dog movably mounted on said blade holder and recesses formed on said support portion at various heights, one of said recesses being engaged by said dog in the locked position, wherein said locking means is adapted to press said support portion against an adjustable support member in said blade holder, said support member comprising a pin mounted in one of several holes formed in said blade holder whereby the pitch of the blade mechanism can be adjusted by moving said pin from one hole to another.

13. A plow apparatus according to claim 1 or 12, wherein said blade holder includes a vertically extending front portion, a first horizontal portion extending rearwardly from the bottom end of said front portion and containing said opening, and a second horizontal portion extending rearwardly from said front portion and spaced above said first horizontal portion, said locking means being pivotally connected to said second horizontal portion.

14. A plow apparatus according to claim 1 or 12 wherein said blade dog is a generally L-shaped member having two arms extending from a central pivot portion pivotally connected to said blade holder, the outer end of one arm being connected to a piston of a hydraulic cylinder means for pivoting said L-shaped member, the outer end of the other arm holding a dog pin for engaging a selected one of said recesses formed on said support portion.

15. A plow apparatus for laying cable, pipe, tile, tubing and the like under ground comprising a blade mechanism having an upwardly extending support portion, a blade holder for connecting said support portion to a plow-pulling vehicle, said holder having an opening therein to receive said support portion, means for pressing said support portion against an interior surface of said holder in said opening, and means for locking said support portion in said holder at a selected height wherein the cutting depth of said blade mechanism can be adjusted, said locking means including a blade dog movably mounted on said blade holder and recesses formed on said support portion at various heights, one of said recesses being engaged by said dog in the locked position, and including a supporting linkage mechanism for connecting said blade holder to a plow-pulling vehicle, said linkage mechanism being pivotally connected at two locations to said blade holder and comprising a vertical support member for connecting the linkage mechanism to said vehicle, front top link means pivotally connected to the upper end of said vertical support member, rear top link means pivotally connected to said front top link means and said blade holder, front bottom link means pivotally connected to the lower end of said vertical support member, rear bottom link means pivotally connected to said front bottom link means and said blade holder, and means for controlling the position of the link means relative to one another.

16. A plowing machine for laying cable, pipe, tile, tubing and the like comprising a tractor and a plow apparatus mounted on the rear end of said tractor, said apparatus comprising a blade mechanism having an upwardly extending support portion, a blade holder for mounting said support portion to the plow-pulling tractor, said holder having an opening therein to receive said support portion, means for pressing said support portion against an interior surface of said holder in said opening, and means for locking said support portion in said holder at a selected height whereby the cutting depth of said blade mechanism can be adjusted, said locking means including a blade dog movably mounted on said blade holder and recesses formed on said support portion at various heights, one of said recesses being engaged by said dog in the locked position, wherein said pressing means includes an arm pivotally mounted on said blade holder at one end of said arm and means for pivoting said arm so that the other end of the arm is pressed against or moved away from said support portion as desired.

17. A plow apparatus for laying cable, pipe, tile, tubing and the like underground comprising a blade mechanism having an upwardly extending support portion, a blade holder for connecting said support portion to a plow-pulling vehicle, said holder having an opening therein to receive said support portion, power actuated pressing means for pressing said support portion against an interior surface of said holder to grip said support portion in said opening, and power actuated locking means for locking said support portion in said holder, said locking means including a blade dog movably mounted on said blade holder adapted to engage in a selected one of a plurality of recesses formed on said support portion at various heights, said pressing means and said locking means being remotely operable and when released enabling said support portion to be moved upwardly or downwardly with respect to said opening to register a selected recess with said blade dog, whereby upon engagement of said pressing means and said locking means said blade mechanism is automatically secured to said blade holder at a desired cutting depth.

* * * * *